US007207201B1

(12) United States Patent
Chuang

(10) Patent No.: US 7,207,201 B1
(45) Date of Patent: Apr. 24, 2007

(54) U/Z-SHAPED STEEL BAR MANUFACTURING PROCESS

(76) Inventor: Sen-Jung Chuang, No. 90-10, Hsia Kwei Jou San, Tan Shui Chen, Taipei County (TW)

( * ) Notice: Subject to any disclaimer, the term of this patent is extended or adjusted under 35 U.S.C. 154(b) by 157 days.

(21) Appl. No.: 11/038,074

(22) Filed: Jan. 21, 2005

(51) Int. Cl.
*B21D 28/26* (2006.01)
*B21D 5/08* (2006.01)

(52) U.S. Cl. ..... 72/131; 72/177; 72/181; 83/549; 83/687

(58) Field of Classification Search ..... 72/181, 72/177, 131, 176; 83/549, 687, 691
See application file for complete search history.

(56) References Cited

U.S. PATENT DOCUMENTS 2,127,618 A * 8/1938 Riemenshneider ..... 228/151
2,708,958 A * 5/1955 Crafton ..... 72/129
3,393,547 A * 7/1968 Kortan ..... 72/131
6,769,600 B1 * 8/2004 Knox et al. ..... 234/98
6,997,026 B2 * 2/2006 Fischer ..... 72/181
7,086,582 B2 * 8/2006 Yang et al. ..... 234/109
2001/0011468 A1 * 8/2001 Bradbury et al. ..... 72/178

FOREIGN PATENT DOCUMENTS

JP 58-77714 * 5/1983

* cited by examiner

*Primary Examiner*—Daniel C. Crane
(74) *Attorney, Agent, or Firm*—Troxell Law Office, PLLC

(57) ABSTRACT

Disclosed is an U/Z-shaped steel bar manufacturing process, which includes the steps of (a) supplying a steel sheet material from a material rack to a flattening machine, (b) operating the flattening machine to flatten the steel sheet material and then delivering the steel sheet material to a punch press for punching, (c) operating the punch press to selectively drive the punch dies to punch the steel sheet material with punch holes subject to a predetermined punch pattern, (d) delivering the punched steel sheet material to a roll forming machine and then operating the roll forming machine to ram the punched steel sheet material into an U/Z-shaped steel bar, (e) operating a straightening machine to straighten the U/Z-shaped steel bar, and (f) operating a conveyer to carry the finished product backwards for packing and further delivery or storage.

4 Claims, 26 Drawing Sheets

U/Z-SHAPED STEEL BAR MANUFACTURING PROCESS

BACKGROUND AND SUMMARY OF THE INVENTION

The present invention relates to steel bar manufacturing process and more particularly, to an U/Z-shaped steel bar manufacturing process, which is practical to make U/Z-shaped steel bars having punch holes of different punch patterns.

FIG. 1 illustrates an U/Z-shaped steel bar manufacturing flow according to the prior art. The method comprises the steps of (1) material supply where a steel sheet material 90 is let off from the spindle of a material rack 91 to a roll forming mechanism 92, (2) roll forming where the steel sheet material 90 is rolled into a continuous sheet of U-shaped steel bar 901 or Z-shaped steel bar 902 by the roll forming mechanism 92 (see FIGS. 2 and 3), (3) punching and cutting where the punch die 931 of a hydraulic punch press 93 is operated to punch the continuous sheet of U-shaped steel bar 901 or Z-shaped steel bar 902 with punch holes 9011 or 9021 (see FIGS. 4 and 5) and then a hydraulic cutting die 932 is operated to cut off the continuous sheet of U-shaped steel bar 901 or Z-shaped steel bar 902 subject to the desired length, and (4) conveying where a conveyer (not shown) is operated to deliver finished products backwards for packing and further storage. This U/Z-shaped steel bar manufacturing process still has drawbacks as follows:

1. When punched by the punch die 931 of the hydraulic punch press 93 or cut by the hydraulic cutting die 932, the continuous sheet of U-shaped steel bar 901 or Z-shaped steel bar 902 tends to be deformed, resulting in poor quality of finished product.

2. One punch press can only punch the continuous sheet of U-shaped steel bar 901 or Z-shaped steel bar 902 with a predetermined pattern of punch holes 9011 or 9021. For punching punch holes 9011, 9012, 9013, 9014 of a different punch pattern (see FIGS. 6~16), the continuous sheet of U-shaped steel bar 901 or Z-shaped steel bar 902 must be transferred to another punch press. Therefore, the manufacturer may have to prepare multiple hydraulic punch presses and punch dies for punching different punch holes of different punch patterns. It requires much investment cost and installation space for multiple hydraulic punch presses and punch dies.

The present invention has been accomplished under the circumstances in view. It is therefore the main object of the present invention to provide an U/Z-shaped steel bar manufacturing process, which eliminates the aforesaid drawbacks. According to one aspect of the present invention, the steps of: (a) material supply, (b) material flattening, (c) material punch-hole punching and length-cutting, (d) material shape forming through a roll forming machine, (d) finished product straightening, and (e) finished product packing. This manufacturing process is simple and efficient, preventing deformation of finished product and maintaining the quality of the finished product. According to another aspect of the present invention, the punch press has position-adjustable punch dies. By means of adjusting the position of the punch dies, the punch press is operated to punch the steel sheet material with punch holes subject to the desired punch pattern. According to still another aspect of the present invention, one single punch press can be operated to punch the steel sheet material with punch holes of any of a plural punch patterns, the invention saves much equipment cost and installation space.

DETAILED DESCRIPTION OF THE INVENTION

Figure 1:
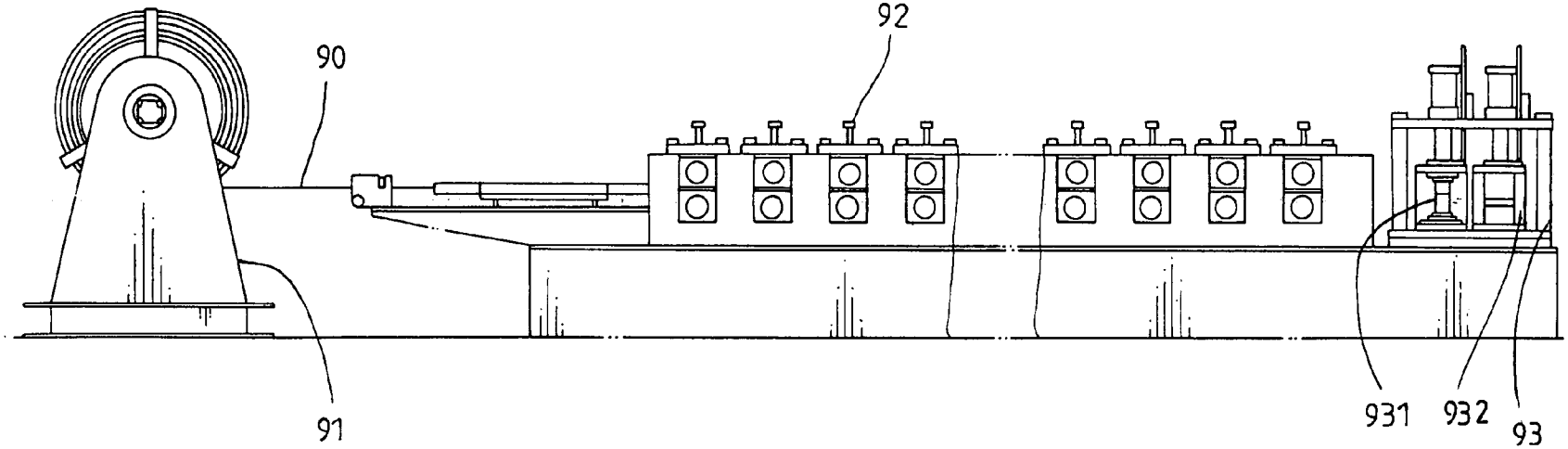
Fig.1 PRIOR ART
FIG. 1 is a schematic side plain view of an U/Z-shaped steel bar manufacturing system according to the prior art.
Figure 2:
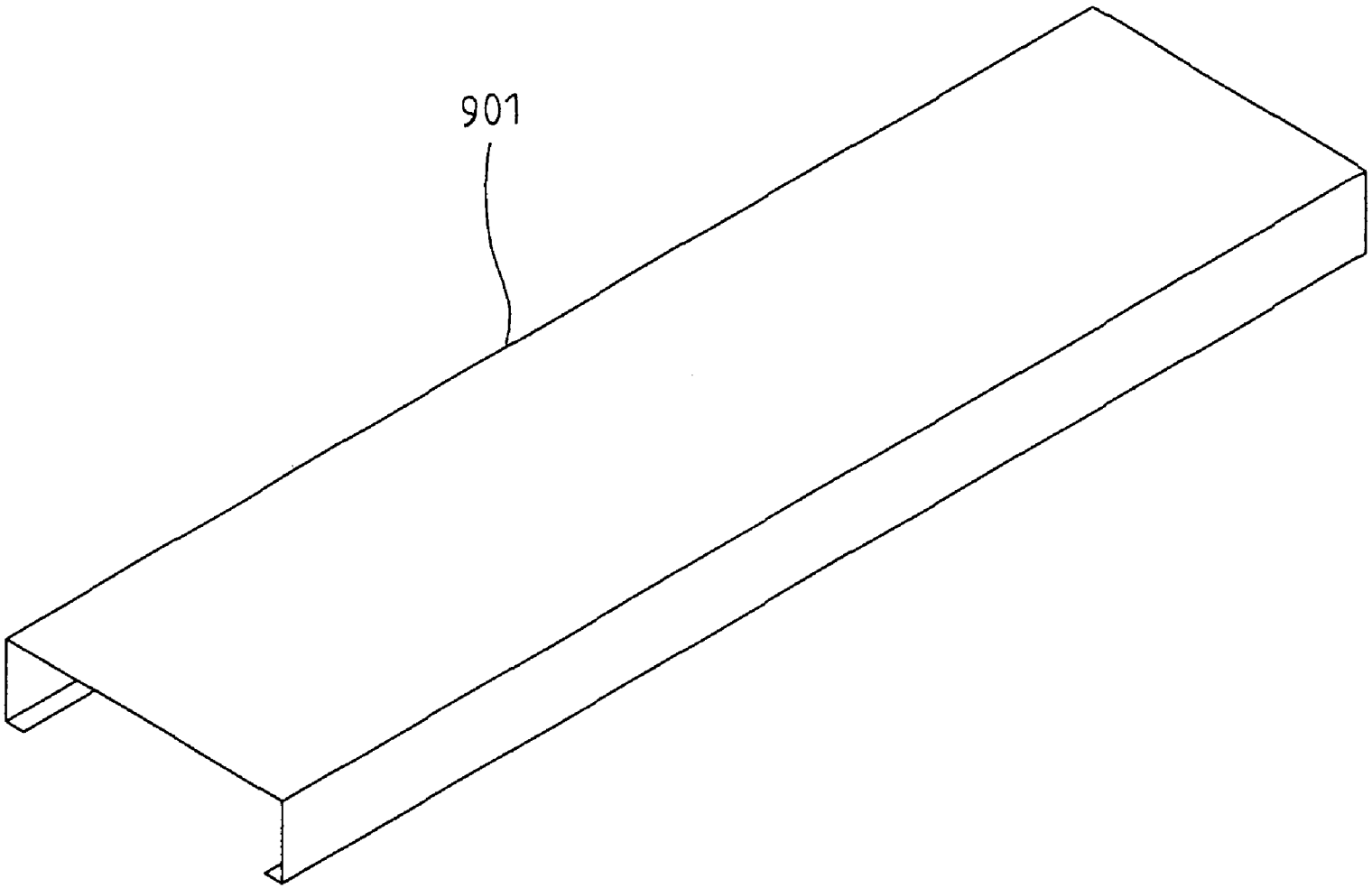
Fig. 2 PRIOR ART
FIG. 2 is an elevational view of an U-shaped steel bar after roll forming process before punching according to the prior art.
Figure 3:
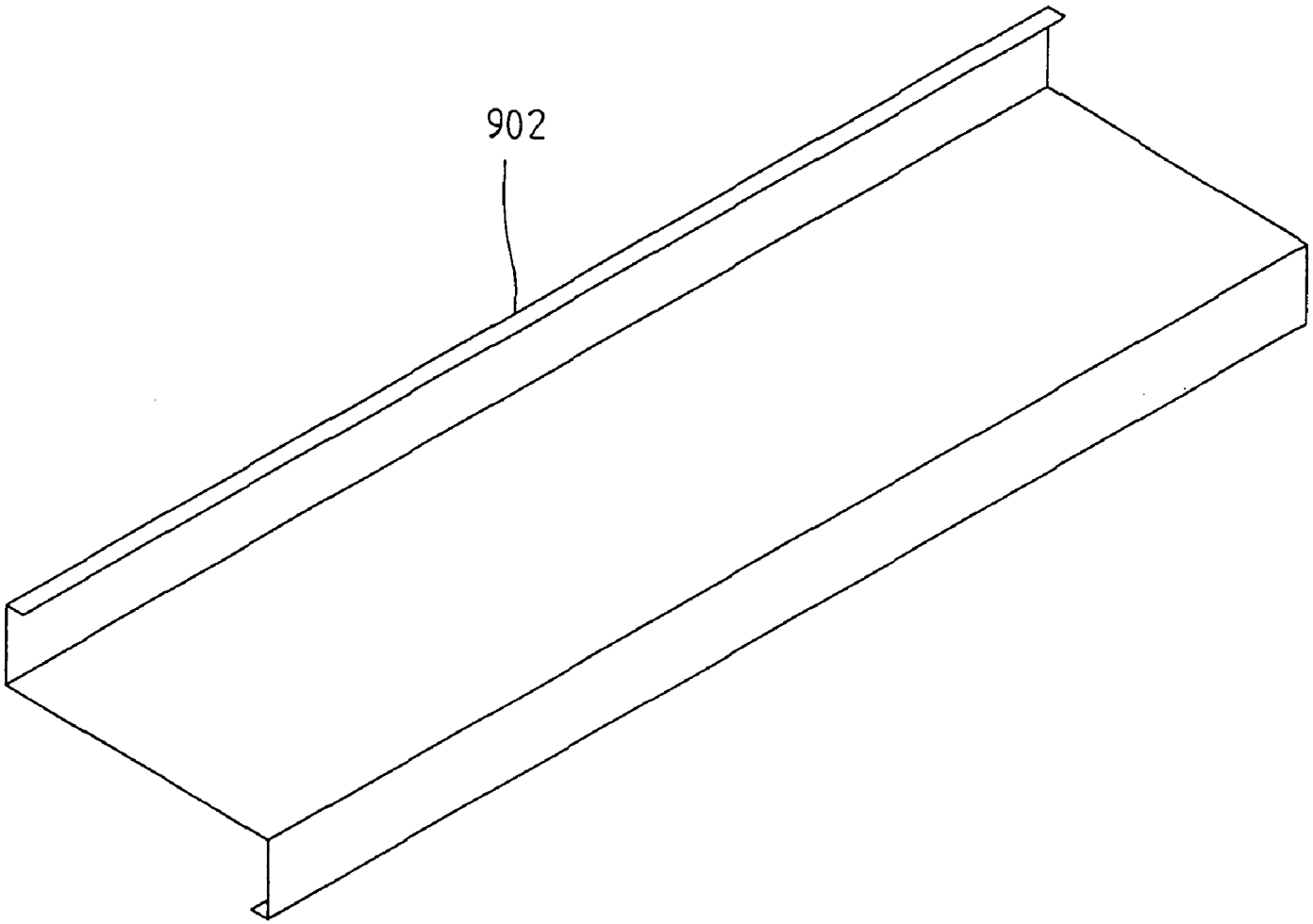
Fig. 3 PRIOR ART
FIG. 3 is an elevational view of a Z-shaped steel bar after roll forming process before punching according to the prior art.
Figure 4:
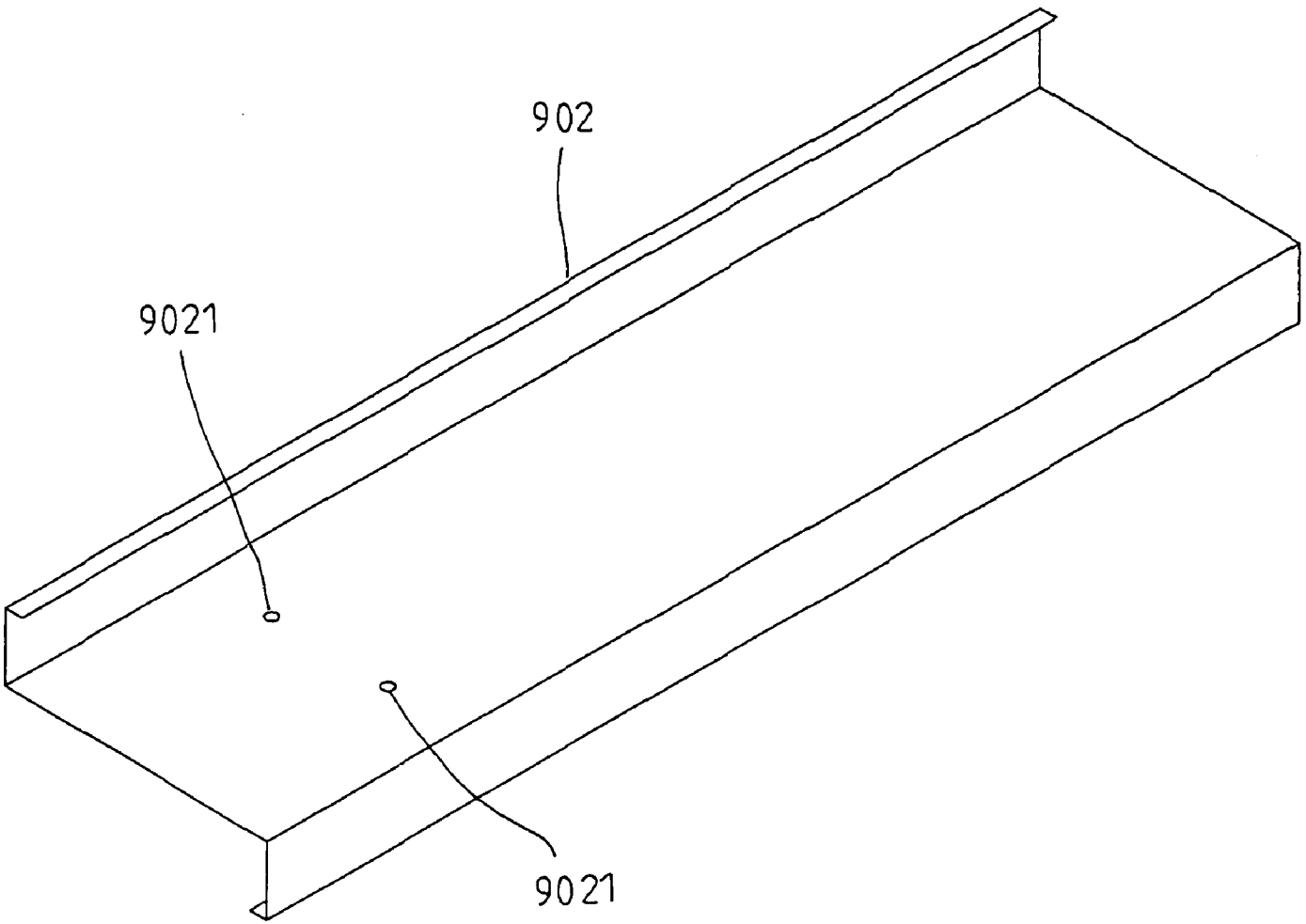
Fig. 4 PRIOR ART
FIG. 4 is an elevational view of a punched Z-shaped steel bar according to the prior art.
Figure 5:
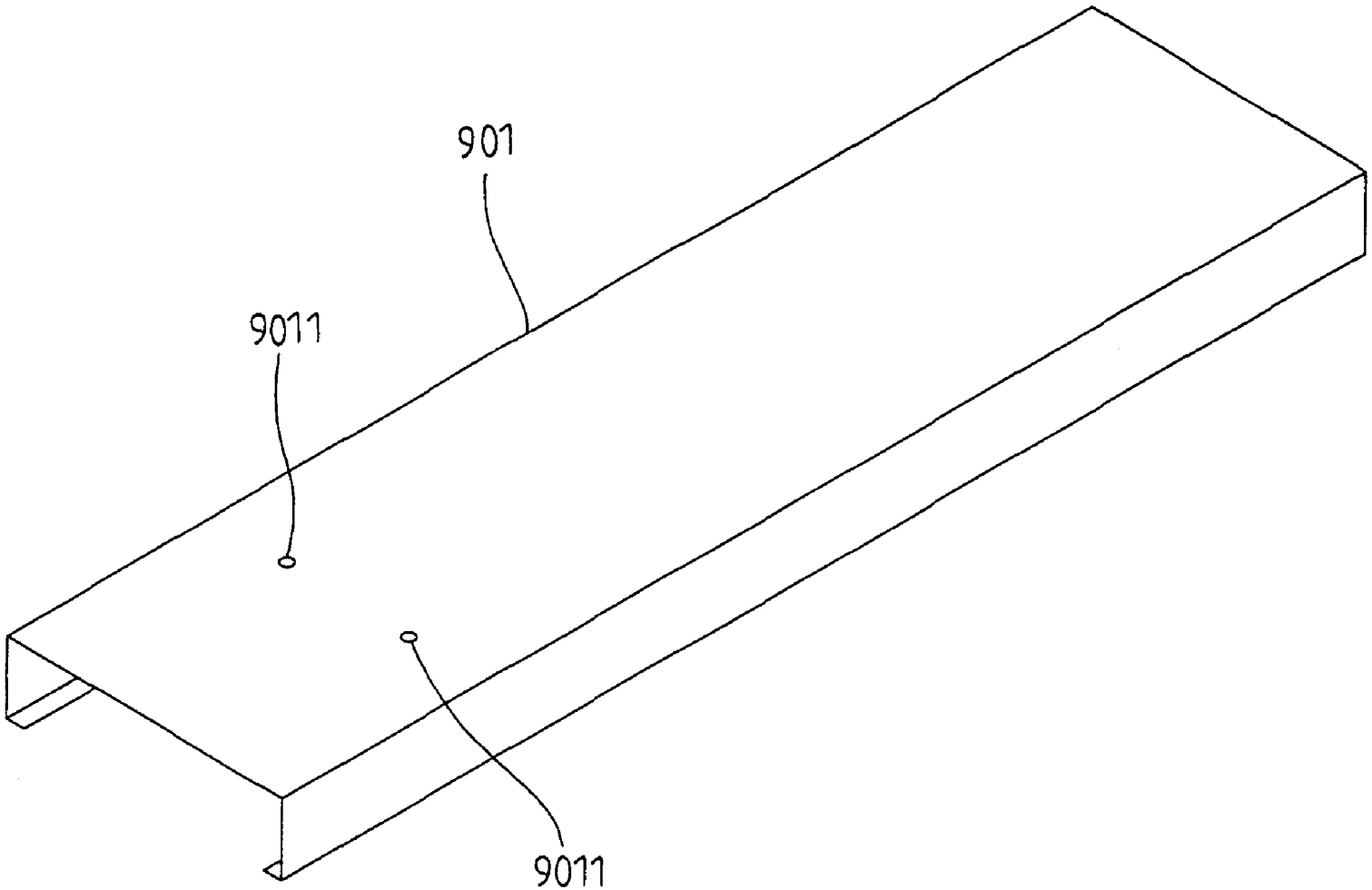
Fig. 5 PRIOR ART
FIG. 5 is an elevational view of a punched U-shaped steel bar according to the prior art.
Figure 6:
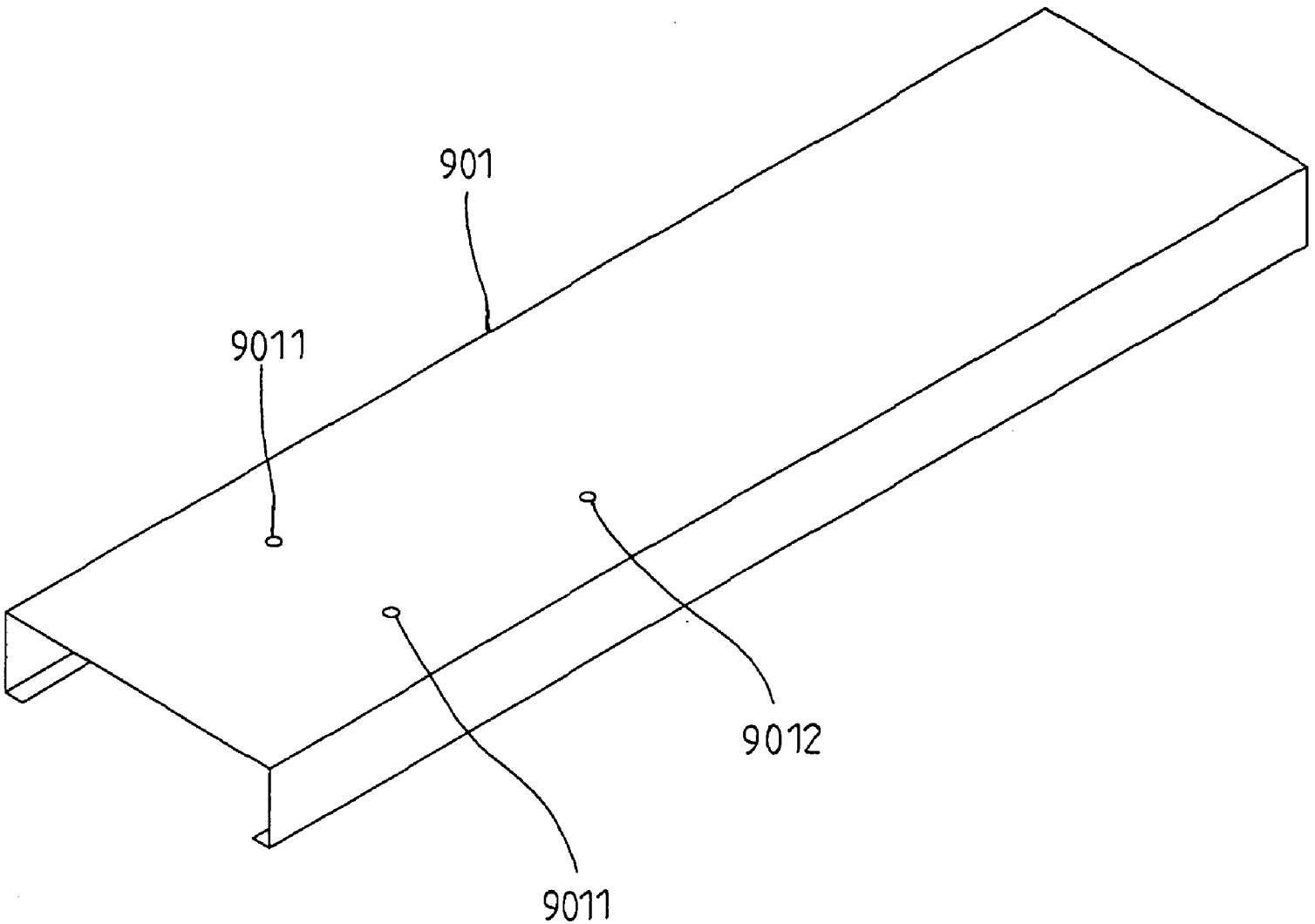
Fig. 6 PRIOR ART
FIG. 6 is an elevational view of another punched U-shaped steel bar showing another punch pattern according to the prior art.
Figure 7:
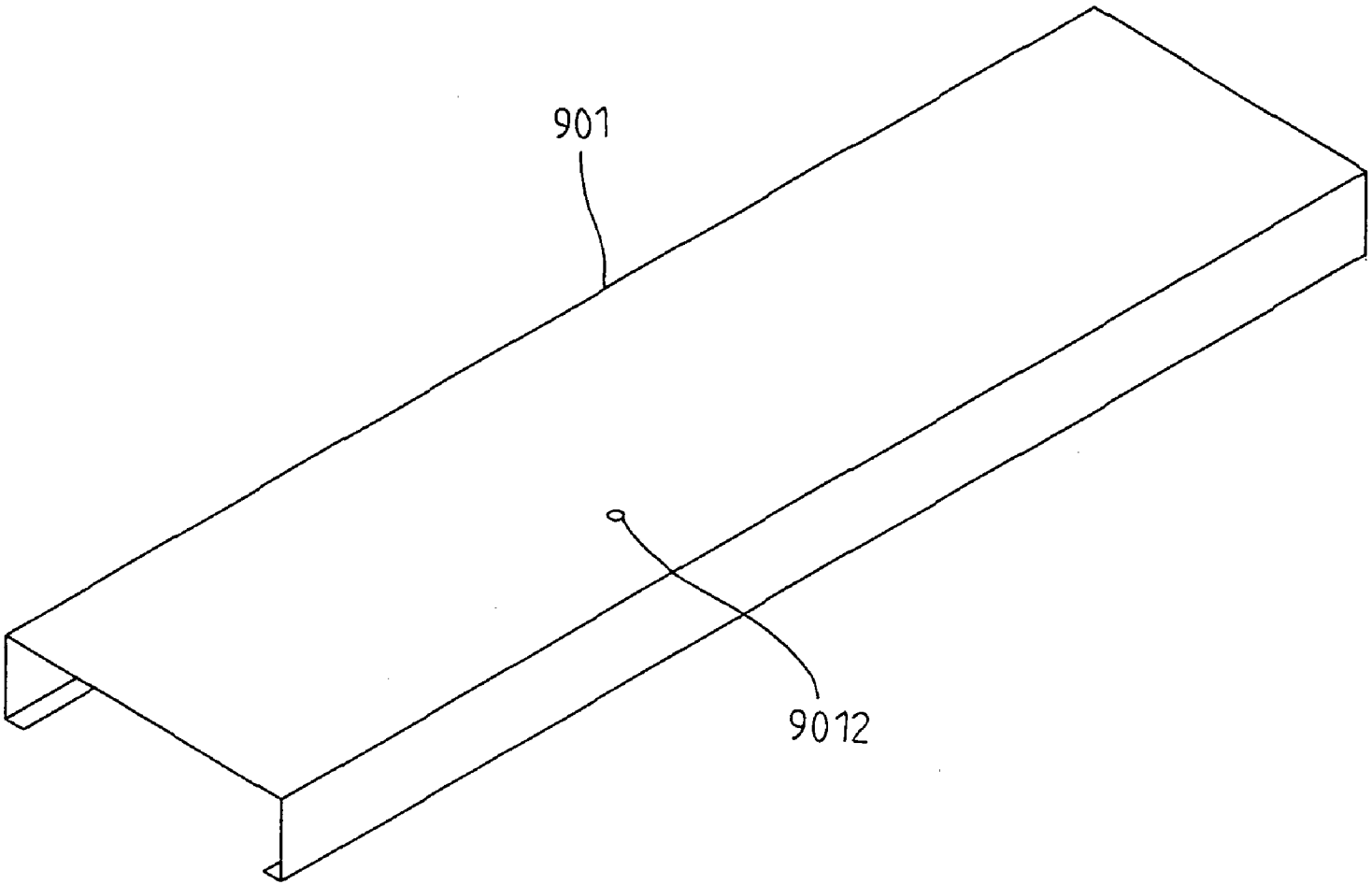
Fig. 7 PRIOR ART
FIG. 7 is an elevational view of still another punched U-shaped steel bar showing still another punch pattern according to the prior art.
Figure 8:
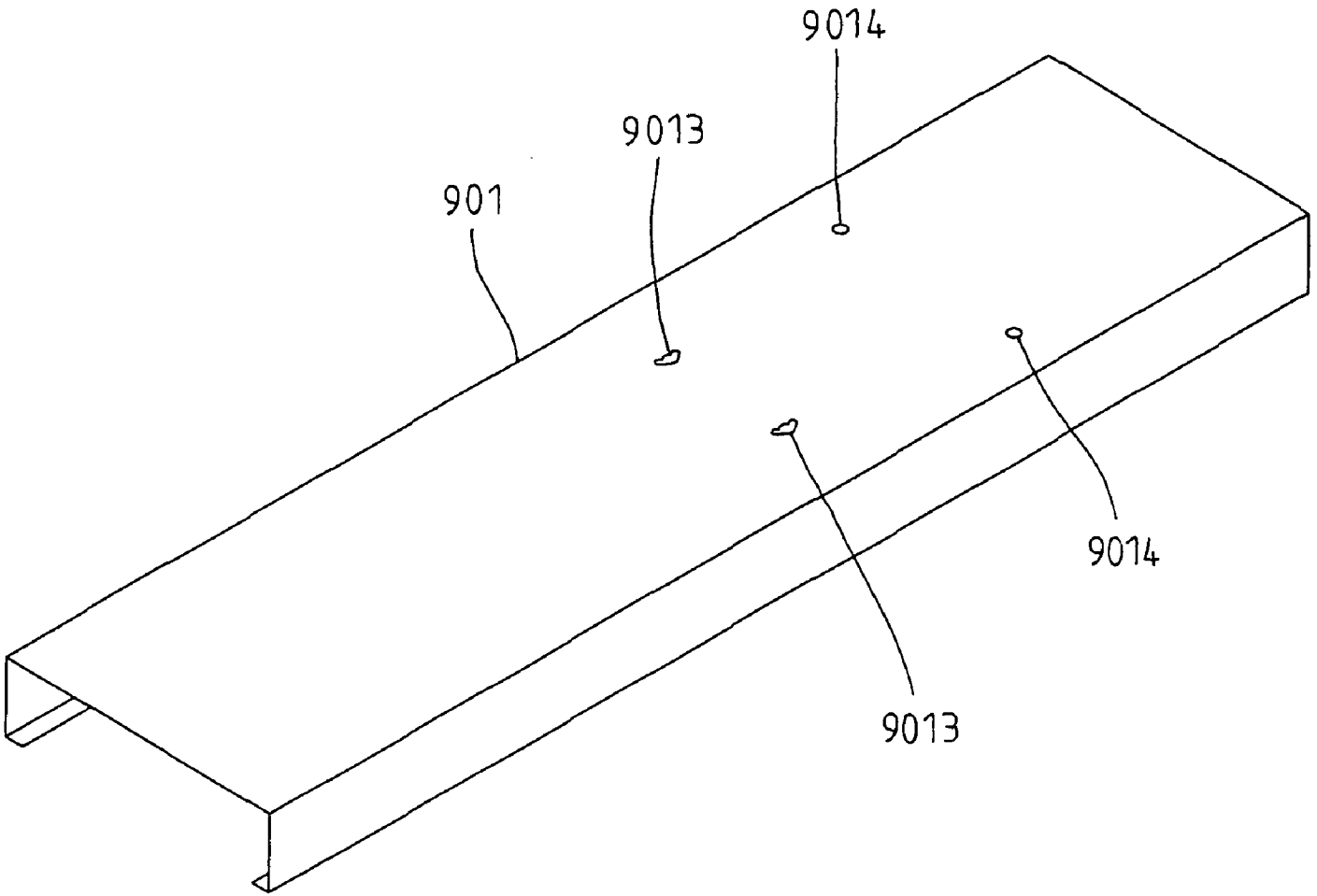
Fig. 8 PRIOR ART
FIG. 8 is an elevational view of still another punched U-shaped steel bar showing still another punch pattern according to the prior art.
Figure 9:
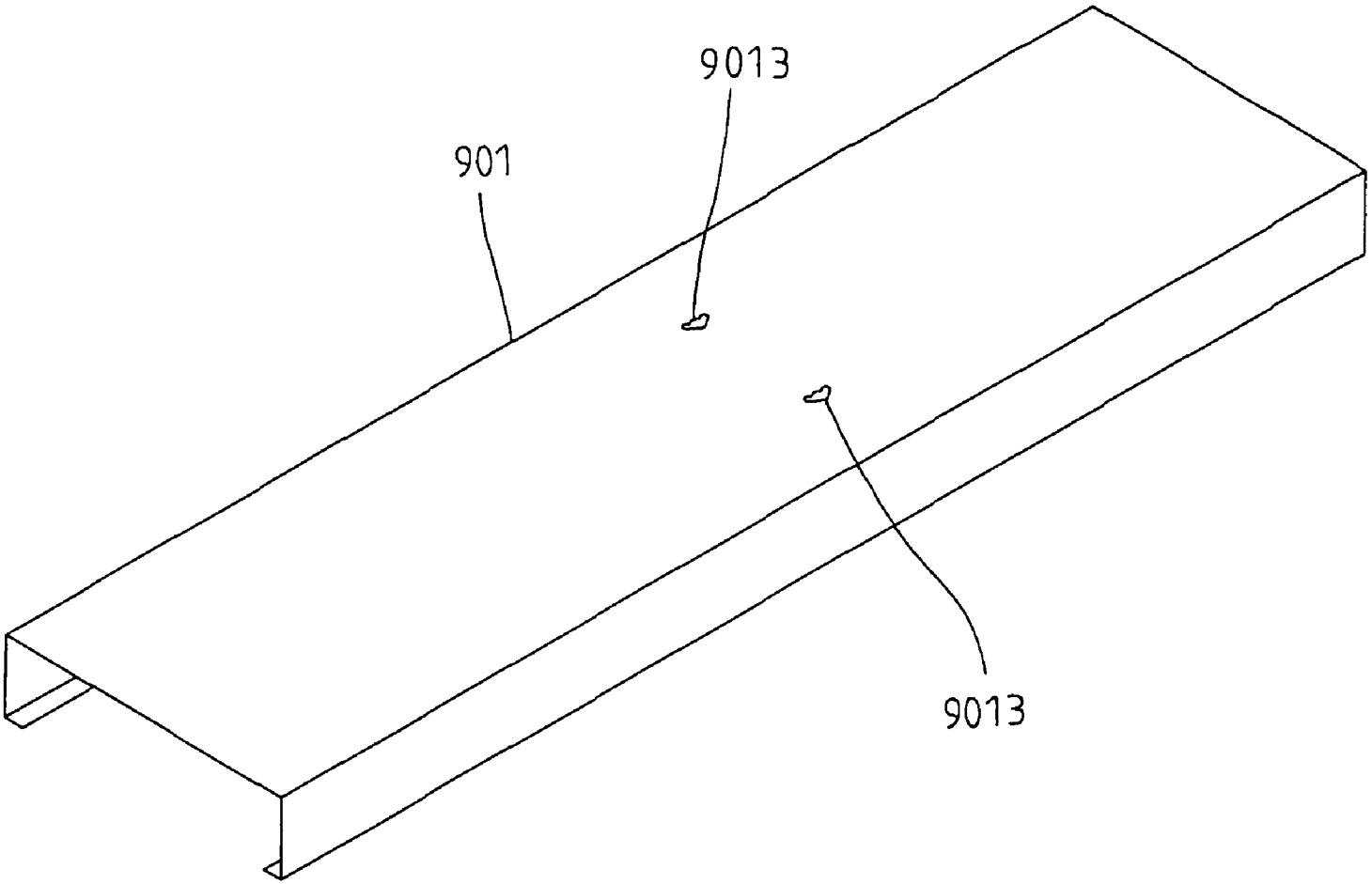
Fig. 9 PRIOR ART
FIG. 9 is an elevational view of still another punched U-shaped steel bar showing still another punch pattern according to the prior art.
Figure 10:
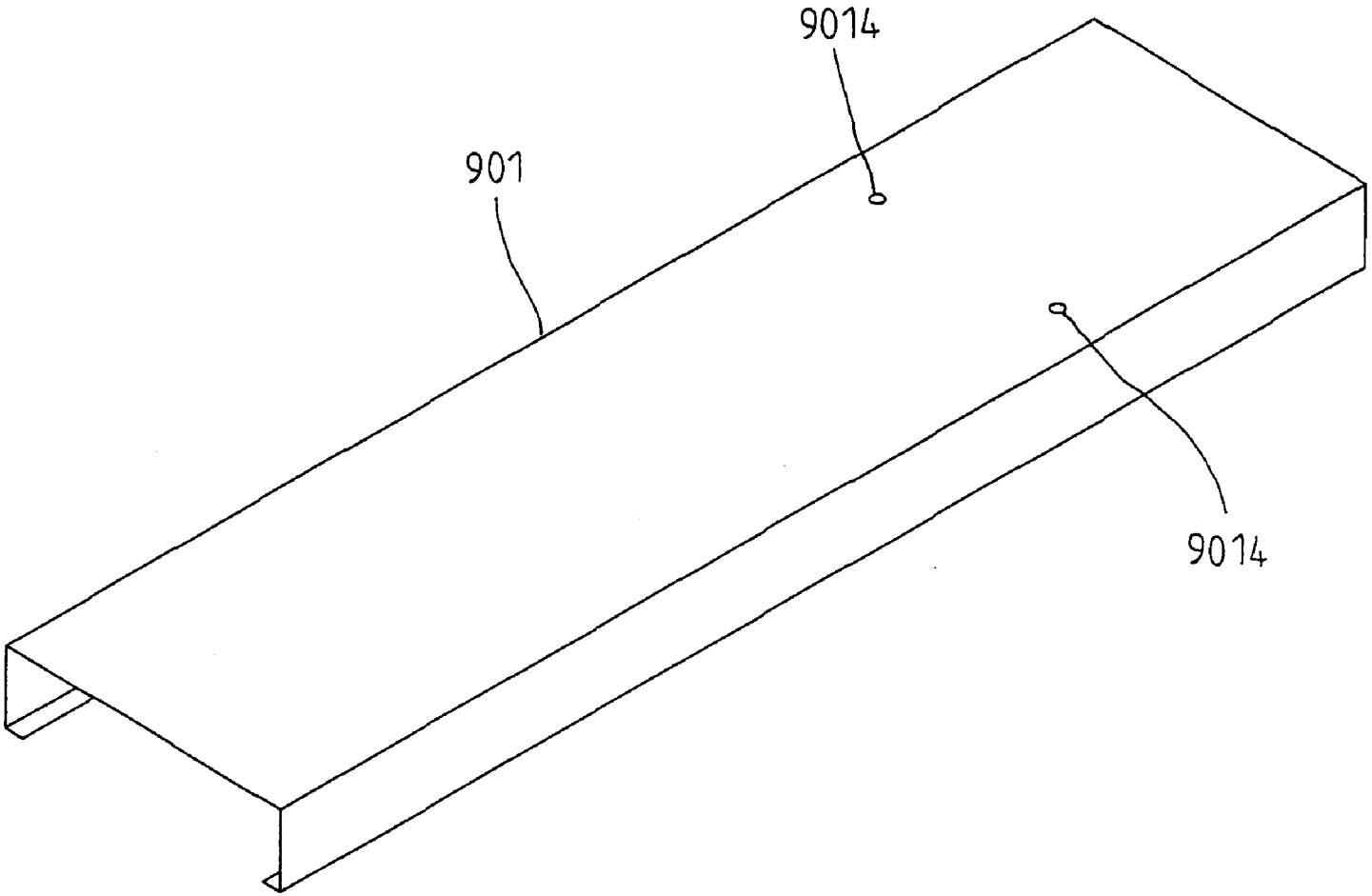
Fig. 10 PRIOR ART
FIG. 10 is an elevational view of still another punched U-shaped steel bar showing still another punch pattern according to the prior art.
Figure 11:
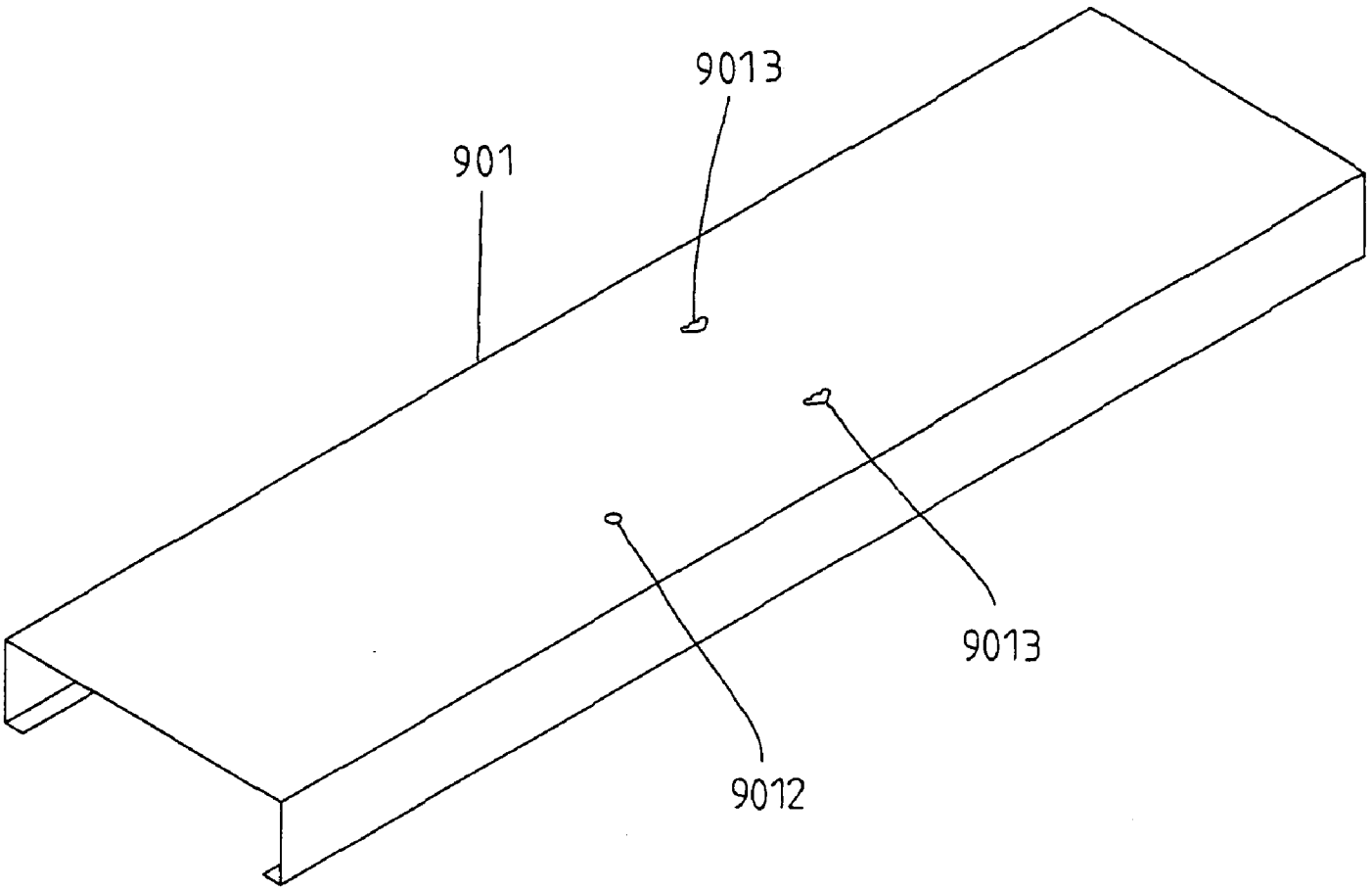
Fig. 11 PRIOR ART
FIG. 11 is an elevational view of still another punched U-shaped steel bar showing still another punch pattern according to the prior art.
Figure 12:
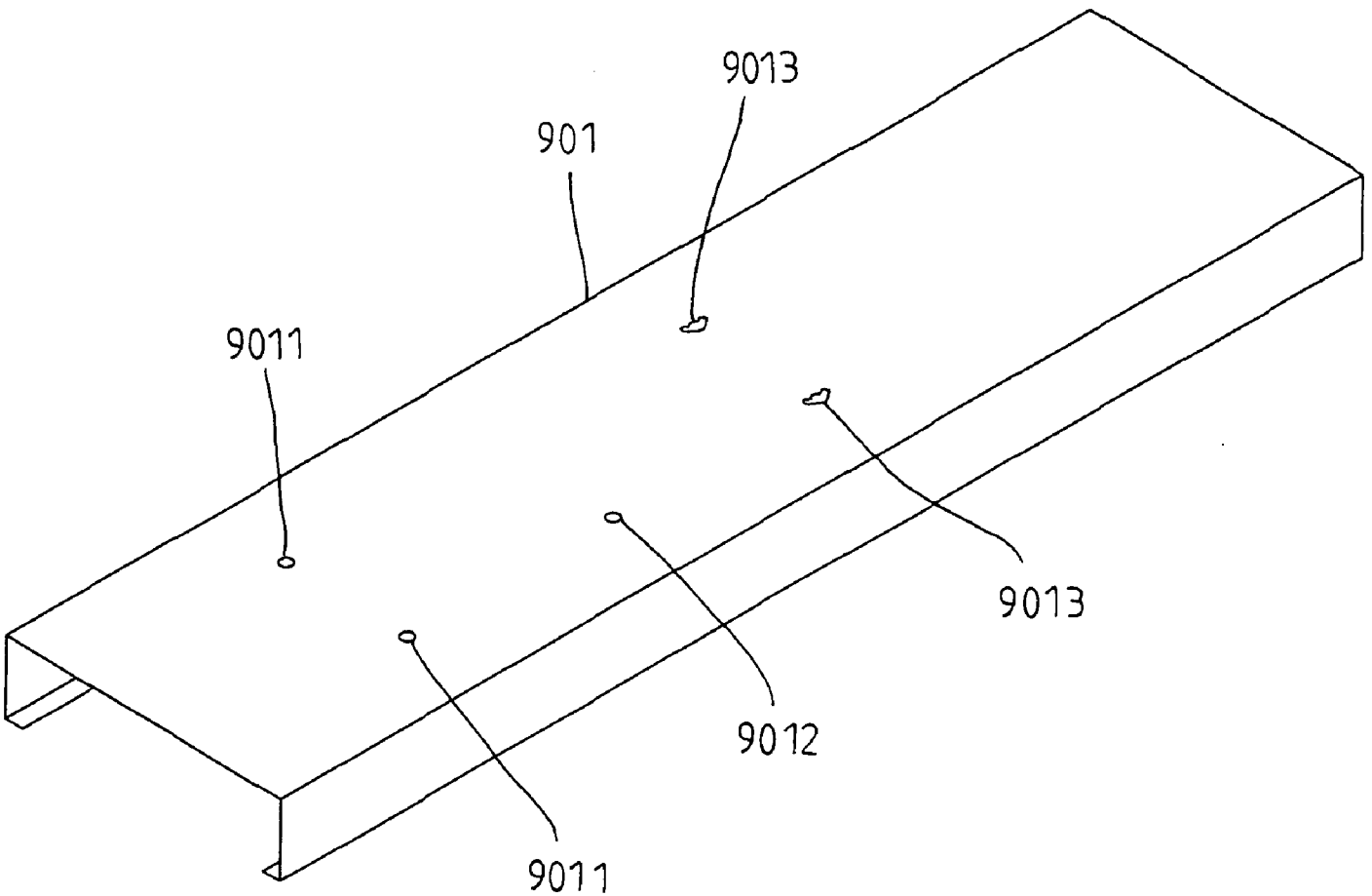
Fig. 12 PRIOR ART
FIG. 12 is an elevational view of still another punched U-shaped steel bar showing still another punch pattern according to the prior art.
Figure 13:
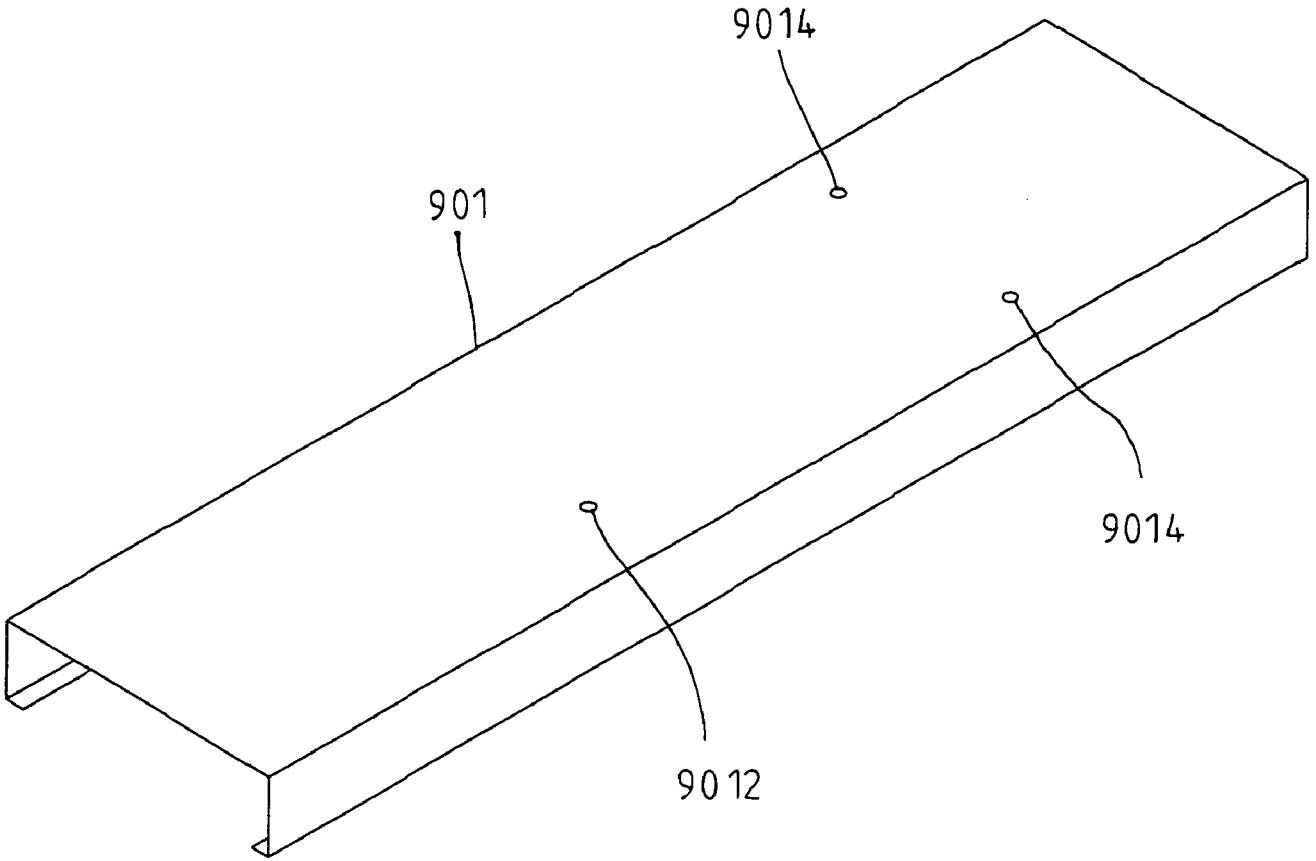
Fig. 13 PRIOR ART
FIG. 13 is an elevational view of still another punched U-shaped steel bar showing still another punch pattern according to the prior art.
Figure 14:
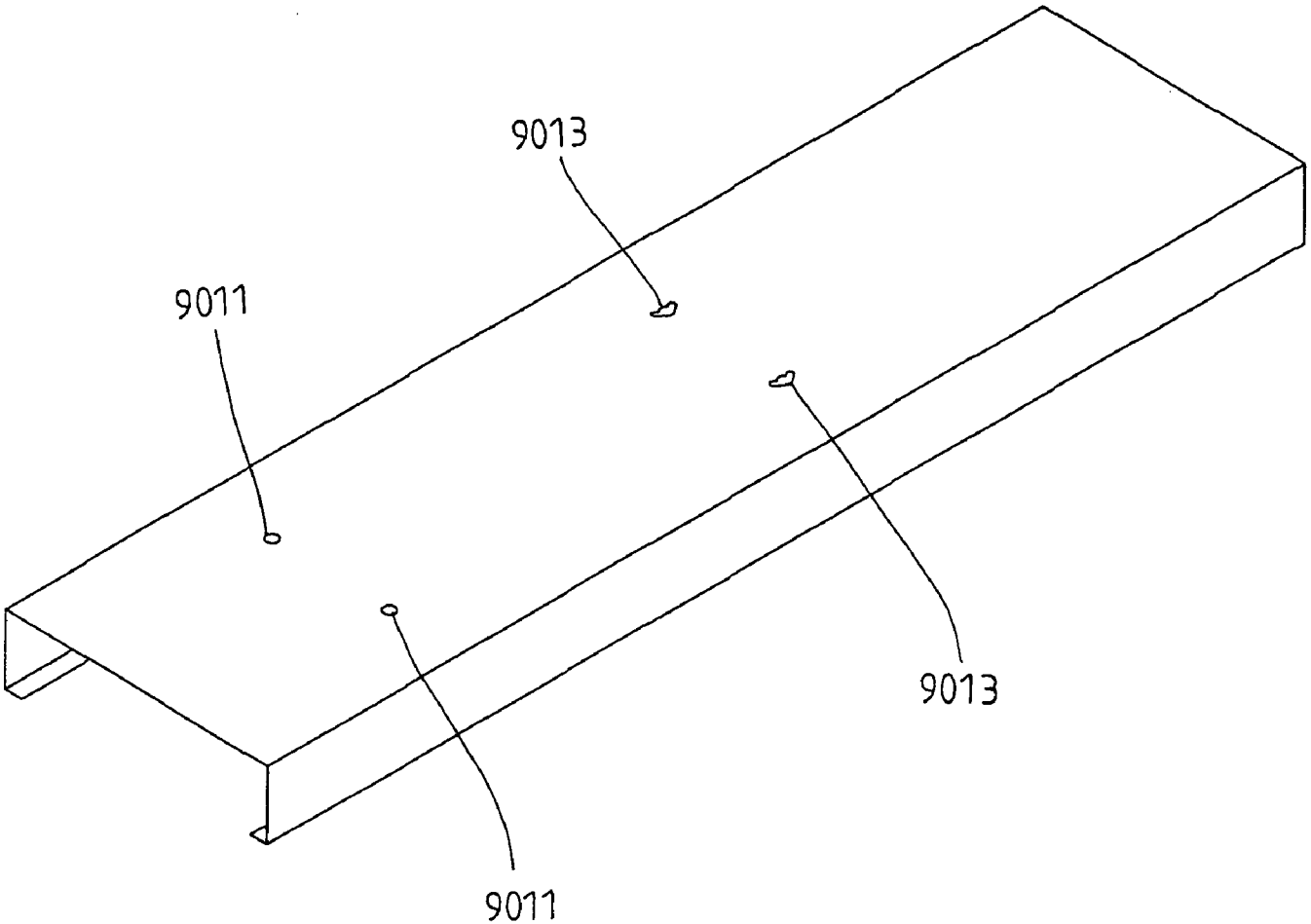
Fig. 14 PRIOR ART
FIG. 14 is an elevational view of still another punched U-shaped steel bar showing still another punch pattern according to the prior art.
Figure 15:
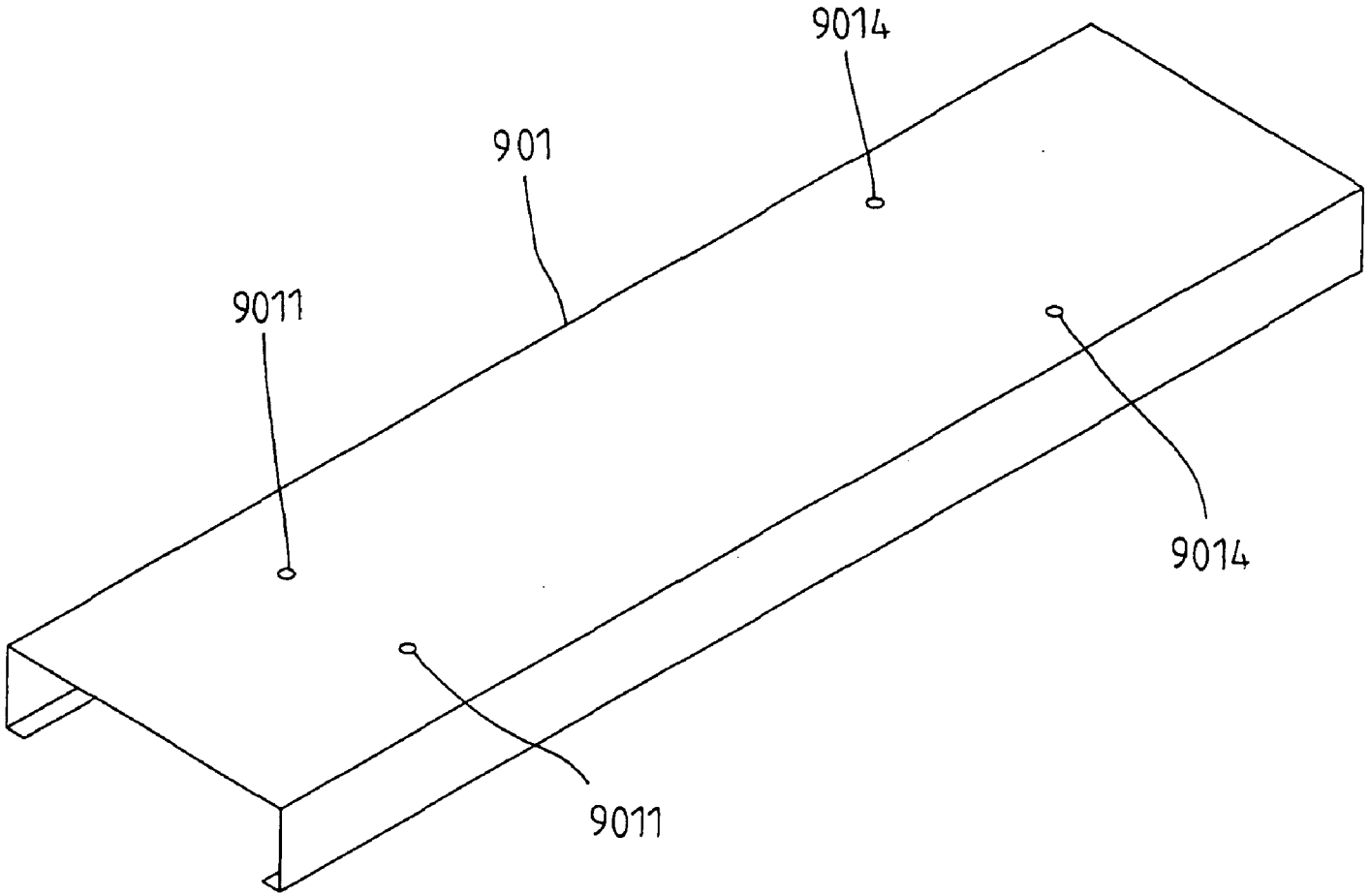
Fig. 15 PRIOR ART
FIG. 15 is an elevational view of still another punched U-shaped steel bar showing still another punch pattern according to the prior art.
Figure 16:
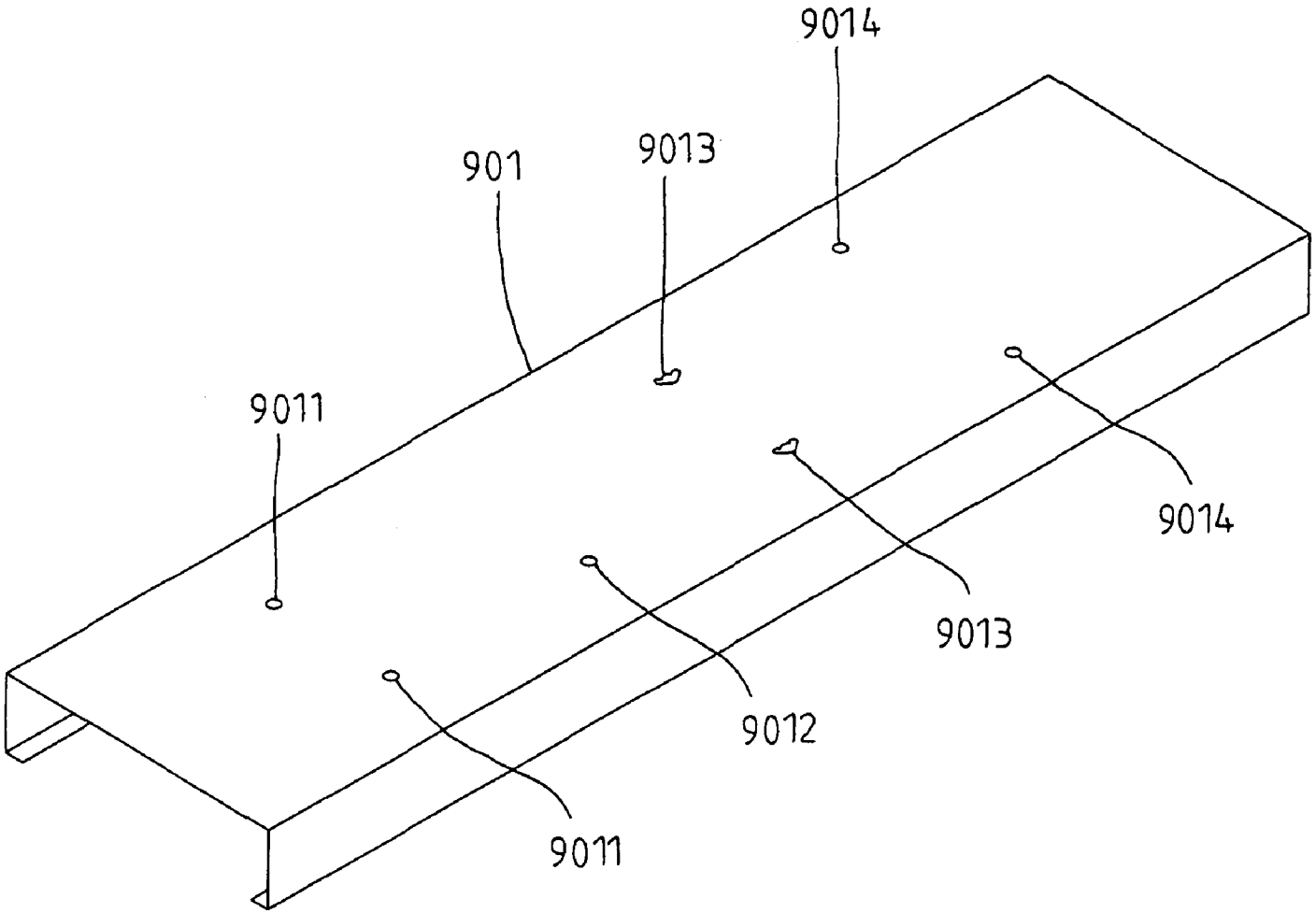
Fig. 16 PRIOR ART
FIG. 16 is an elevational view of still another punched U-shaped steel bar showing still another punch pattern according to the prior art.
Figure 17:
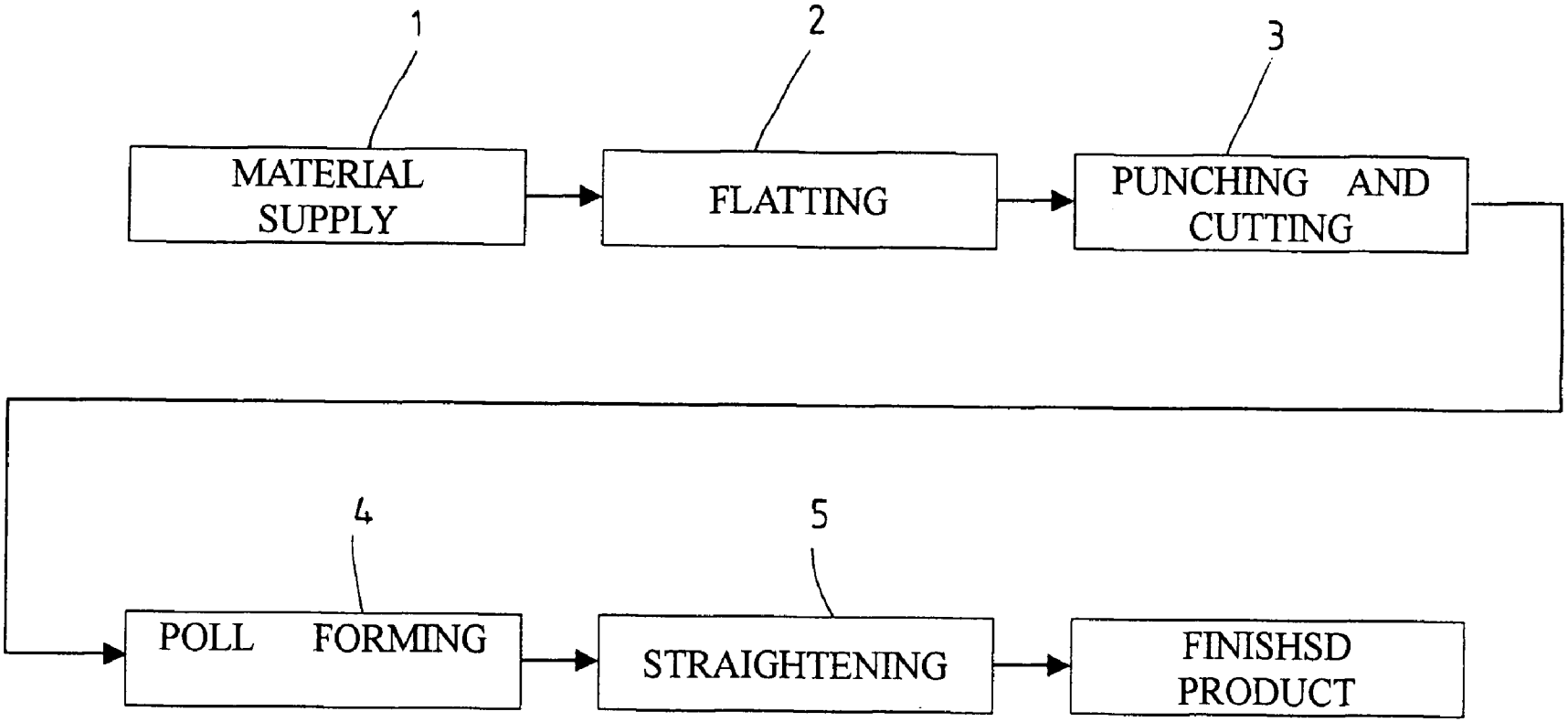
FIG. 17 is a block diagram explaining U/Z-shaped steel bar manufacturing process according to the present invention.
Figure 18:
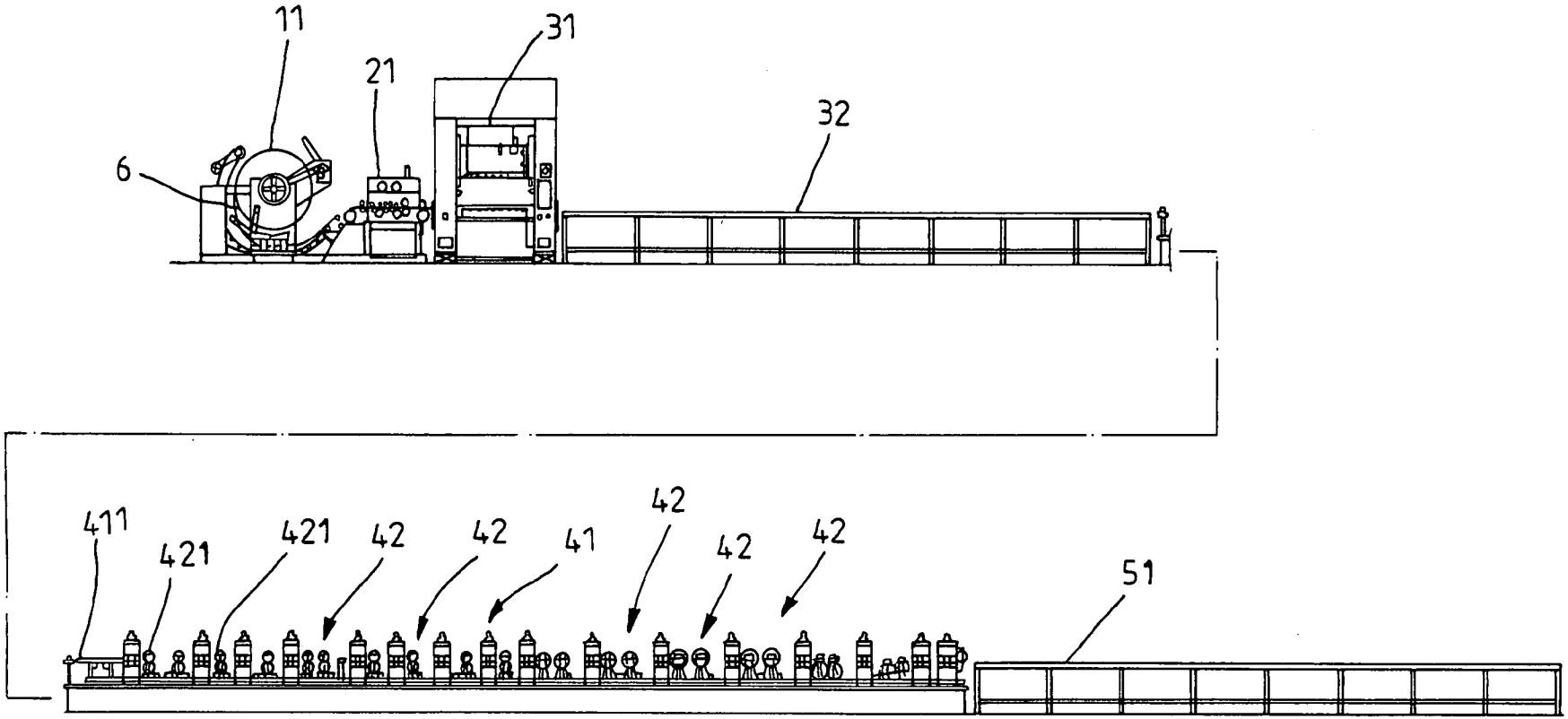
FIG. 18 is a schematic side plain view of an U/Z-shaped steel bar manufacturing system according to the present invention.
Figure 19:
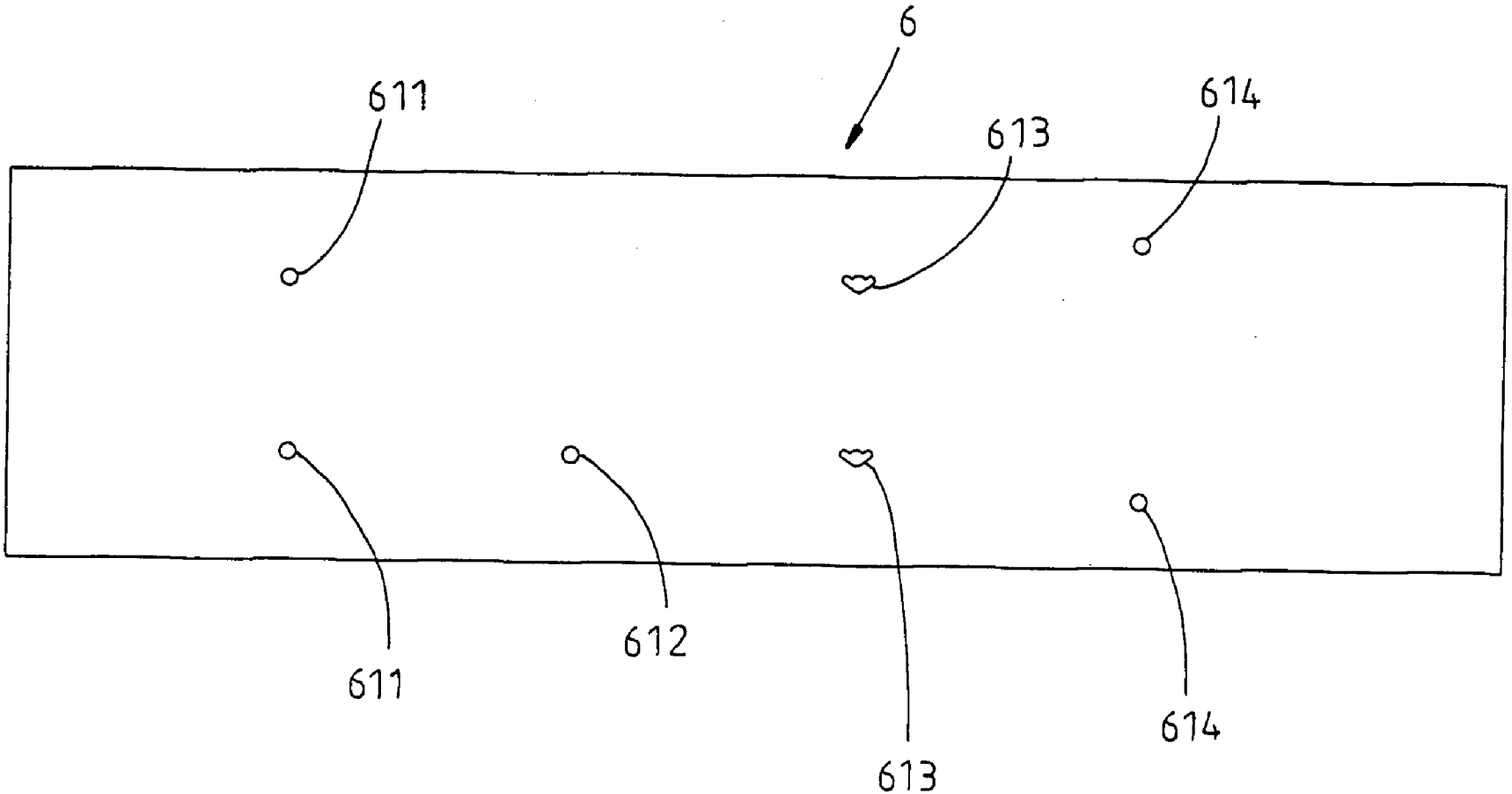
FIG. 19 is a top plain view of a steel sheet material after punching according to the present invention.
Figure 20:
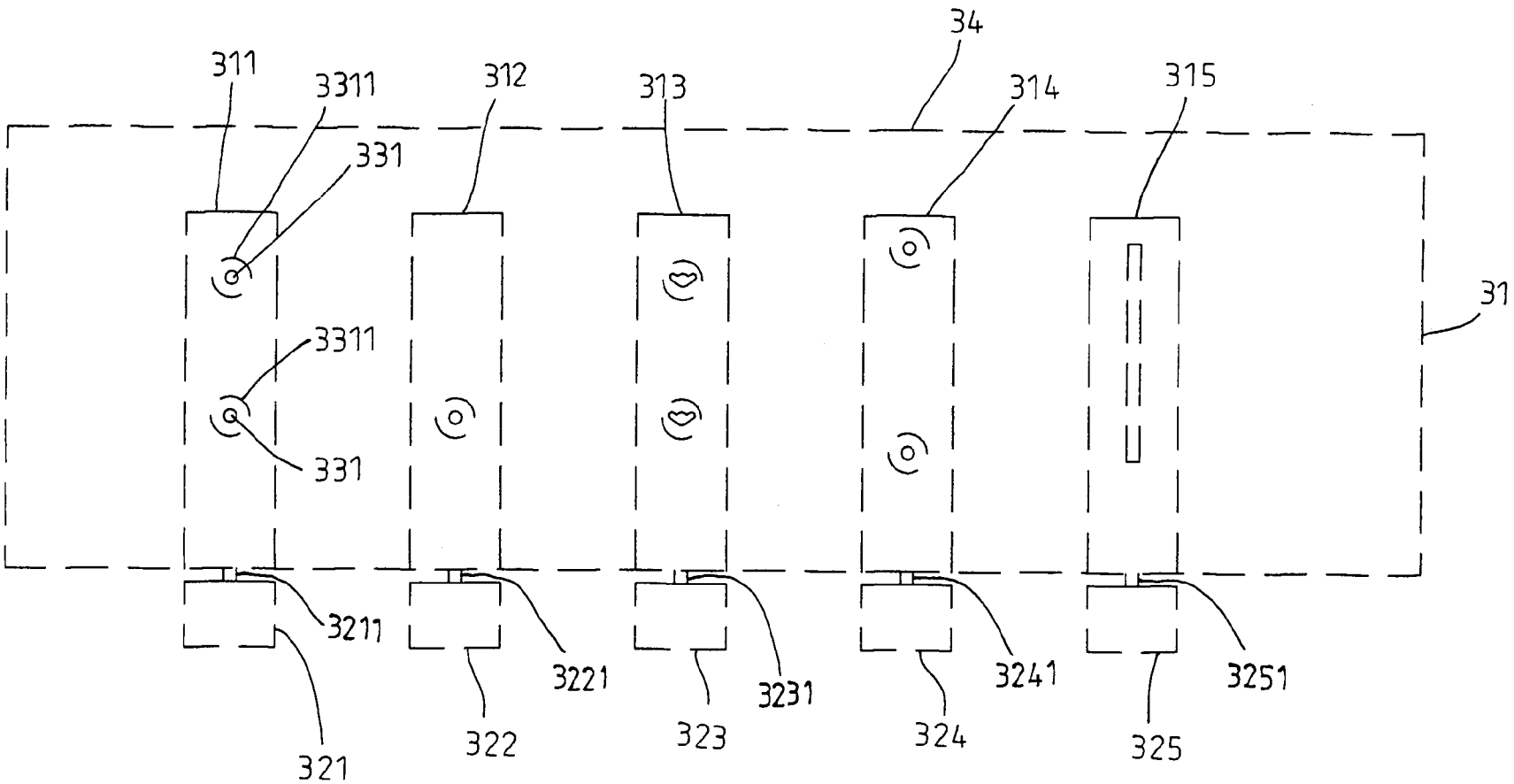
FIG. 20 is a schematic top view of the punch press according to the present invention.
Figure 21:
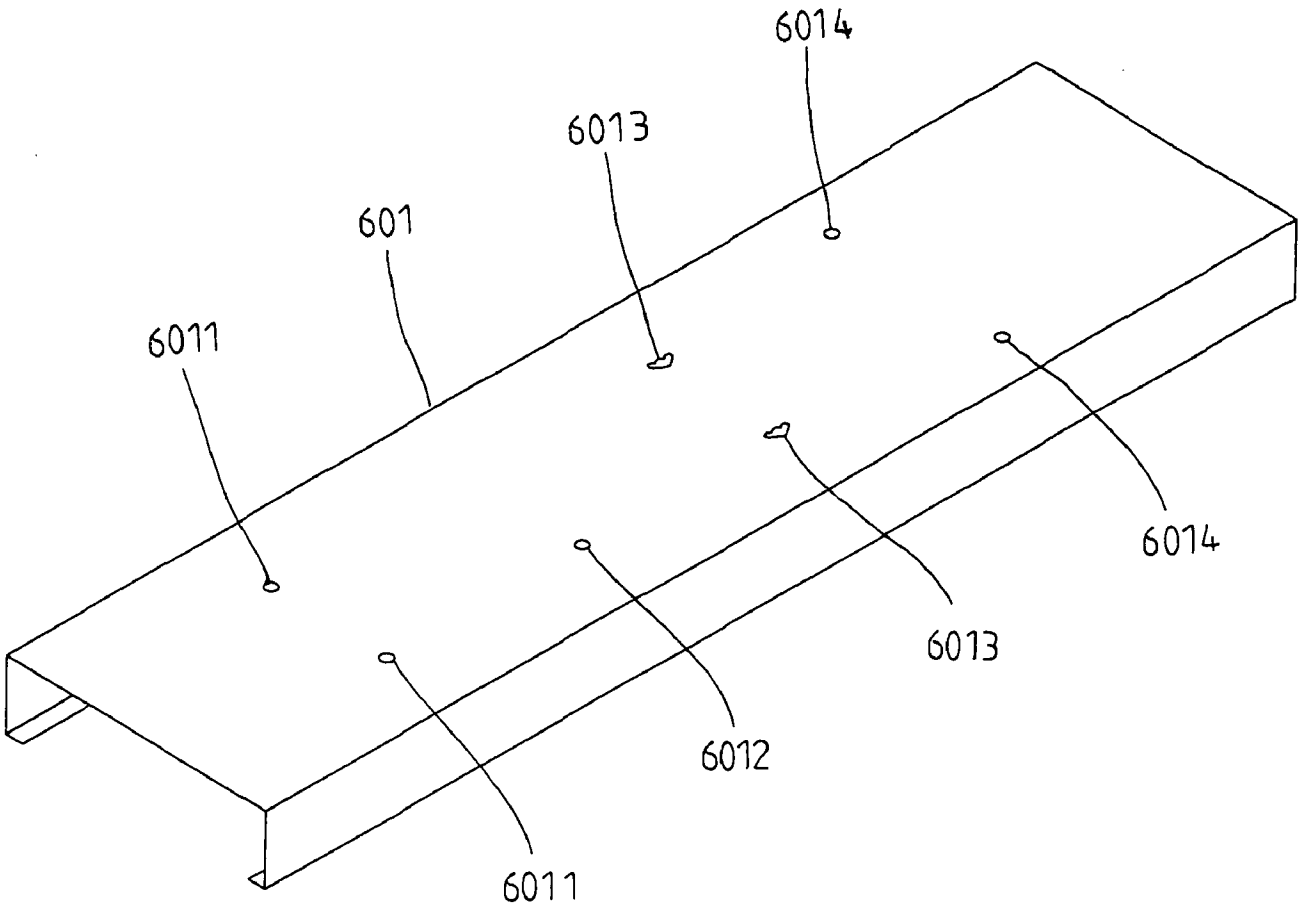
FIG. 21 is a schematic oblique elevation of an U-shaped steel bar made according to the present invention.
Figure 22:
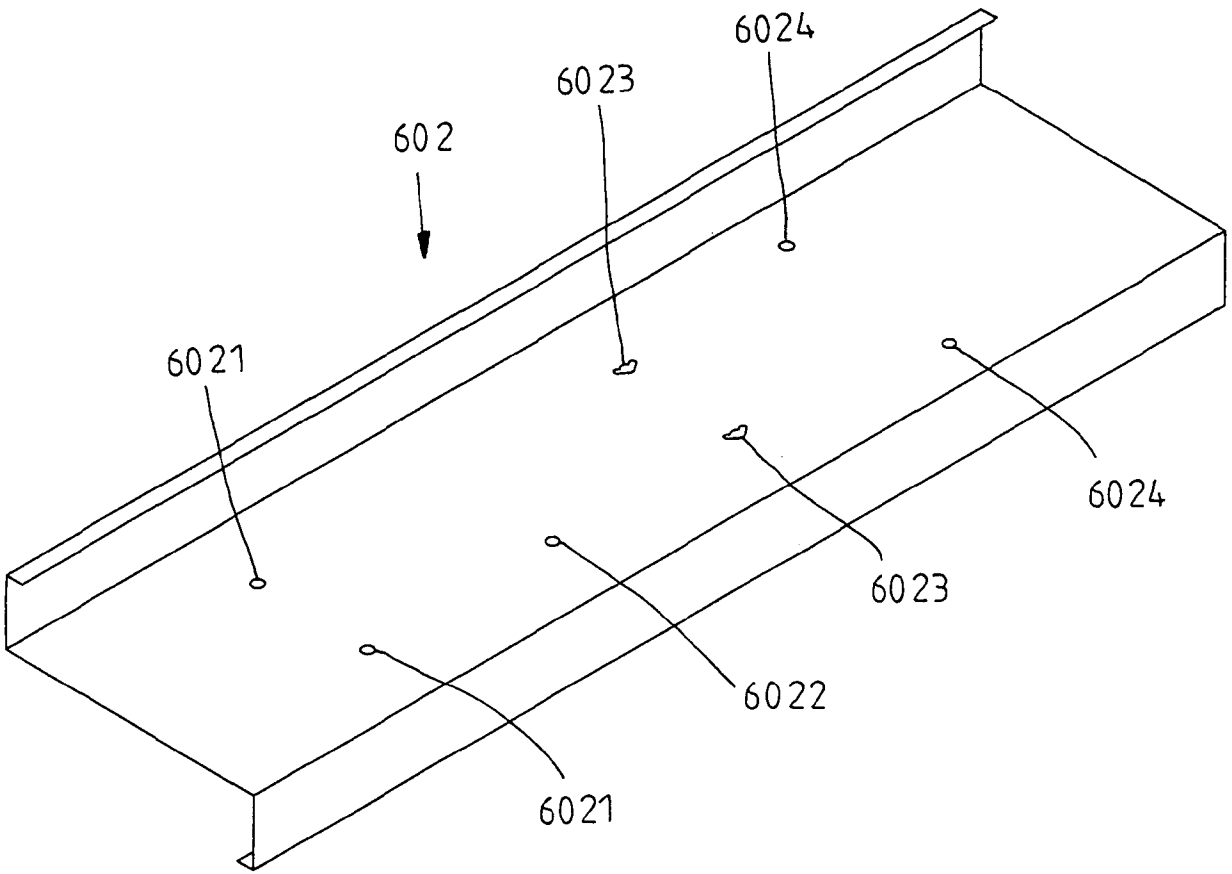
FIG. 22 is a schematic oblique elevation of a Z-shaped steel bar made according to the present invention.
Figure 23:
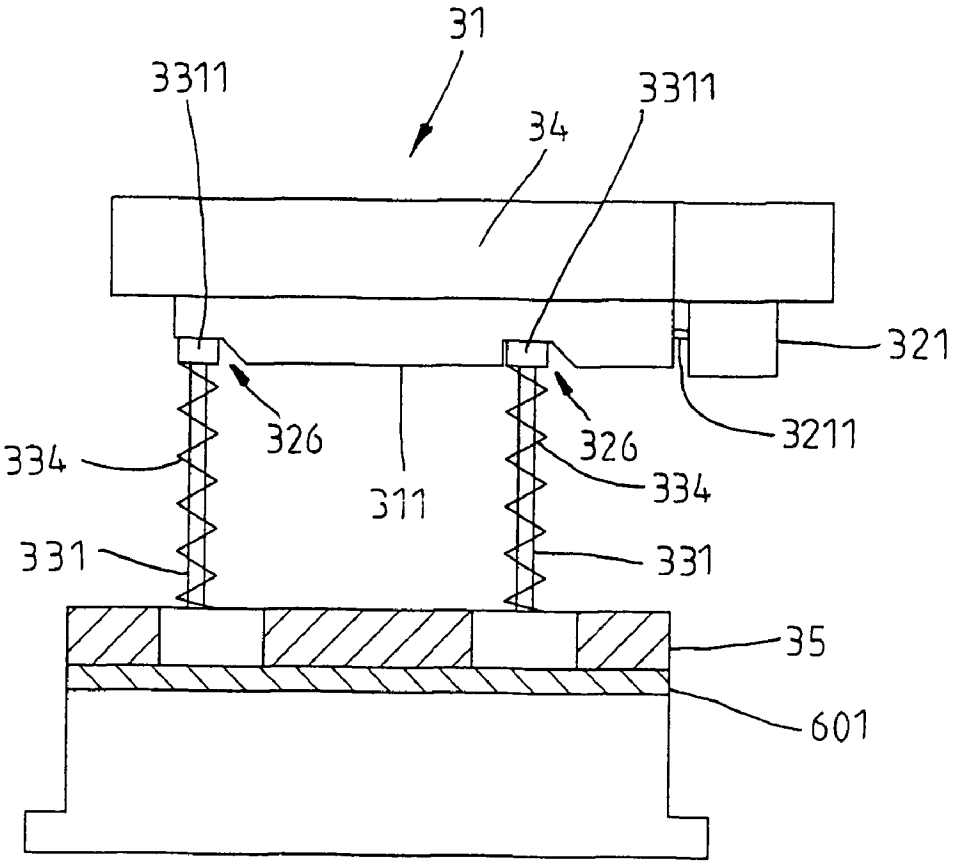
FIG. 23 is a sectional side view of a part of the punch press according to the present invention.
Figure 24:
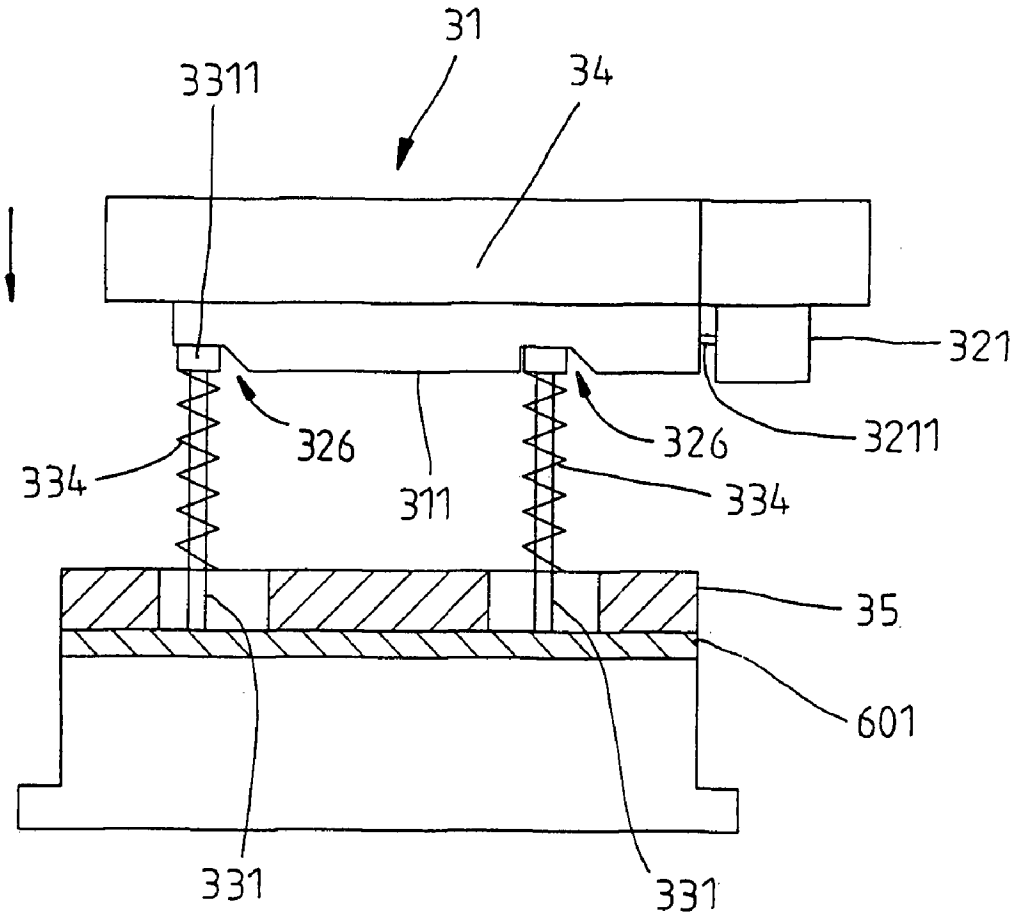
FIG. 24 corresponds to FIG. 23 but showing the punch die lowered with the upper mold.
Figure 25:
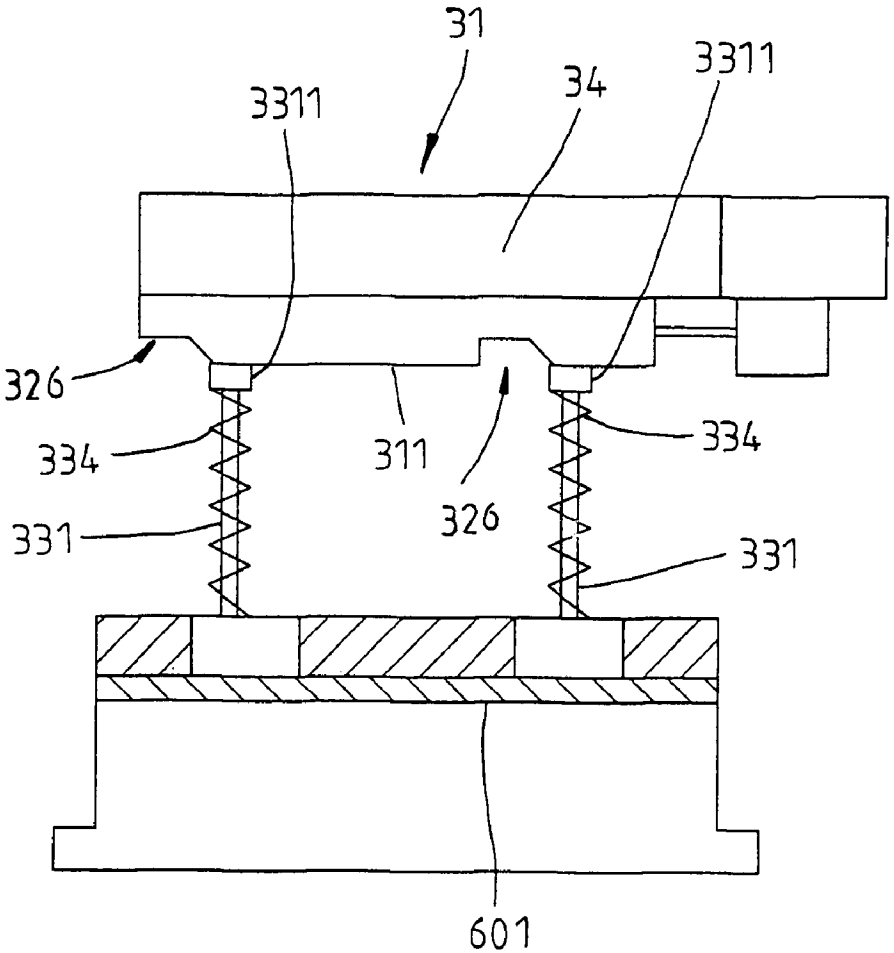
FIG. 25 is similar to FIG. 23 but showing the position of the punch die adjusted.
Figure 26:
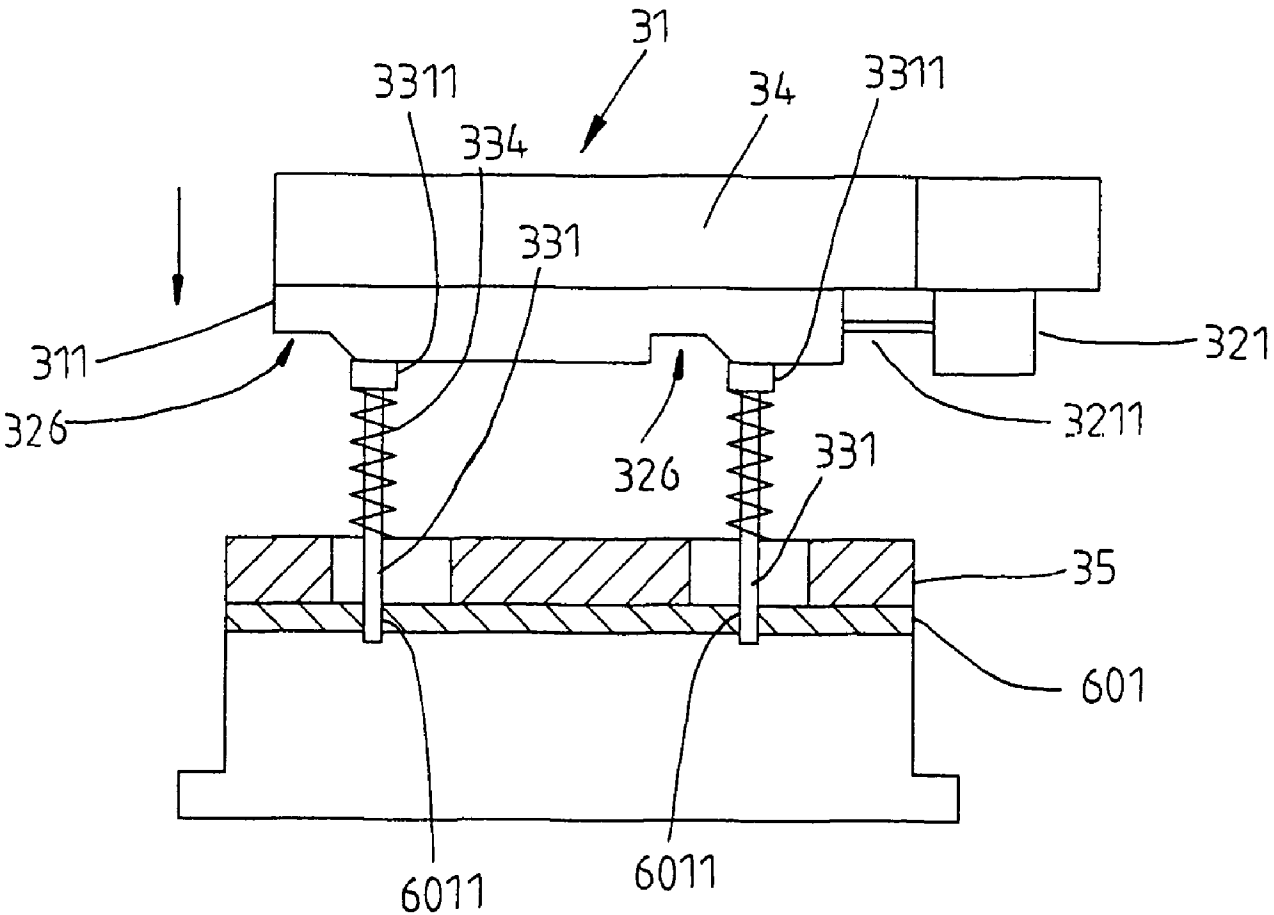
FIG. 26 corresponds to FIG. 25 but showing the punch die lowered with the upper mold.

Referring to FIGS. 17~20, an U/Z-shaped steel bar manufacturing process in accordance with the present invention includes the steps of:

(1) Material supply, where a roll of steel sheet material 6 is supplied from the spindle of a material rack 11 to a flattening machine 21;

(2) Flattening, where the supplied steel sheet material 6 is flattened by the flattening machine 21 and delivered forwards to a punch press 31 for punching;

(3) Punching and cutting, where the flattened steel sheet material 6 is selectively punched with punch holes 611, 612, 613, 614 or 6011, 6012, 6013, 6014 by the movable punch dies 311, 312, 313, 314, 315 subject to a predetermined punch pattern (see FIGS. 19, 20, and 21) and then cut off subject to the desired length;

(4) Roll forming, where the punched steel sheet material 6 is conveyed by a conveyer 32 to the entrance guide 411 of a roll forming machine 41 and then rammed into an U-shaped steel bar 601 (see FIG. 21) or Z-shaped steel bar 602 (see FIG. 22) by the ramming rolls 421 of the roll forming unit 42 of the roll forming machine 41 (the roll forming unit 42 can be adjusted to ram the loaded steel sheet material into an U-shaped steel bar or Z-shaped steel bar as desired; because this adjustment procedure is of the known art, no further detailed description in this regard is necessary);

(5) Straightening, where the U-shaped steel bar 601 or Z-shaped steel bar 602 thus obtained is straightened by a straightening machine (not shown) into the finished product (i.e., the finished U-shaped steel bar 601 with punch holes 6011, 6012, 6013, 6014, 6014 as shown in FIG. 21 or the finished Z-shaped steel bar 602 with punch holes 6021, 6022, 6023, 6024 as shown in FIG. 22); and (6) Packing, where the finished product is carried backwards by a conveyer 51 for packing and further delivery or storage.

Referring to FIGS. 20~26, the aforesaid punch press 31 comprises a plurality of air cylinders 321, 322, 323, 324, 325 arranged in parallel, and the aforesaid punch dies 311, 312, 313, 314, 315 are respectively connected to the pistons 3211, 3212, 3213, 3214, 3215 of the air cylinders 321, 322, 323, 324, 325. The punch dies 311, 312, 313, 314, 315 have respective recessed portions 326. When one punch die 311 is to selected to run idle, the respective air cylinders 321 is operated to extend or retract the respective piston 3211 and to further move the punch die 311 to the position where the heads 3311 of the respective punch rods 331 are forced by the respective spring members 334 into the recessed portions 326 of the punch die 311 so that the respective punch rods 331 do not punch the U-shaped steel bar 601 when the punch die 311 is lowered with the upper mold 34 of the punch press 31 toward the intermediate mold plate 35 (see FIG. 24); on the contrary, when returned the air cylinder 321 to the former position where the recessed portions 326 of the punch die 311 are biased from the respective punch rods 331 (see FIG. 25), the punch rods 331 can be forced through the U-shaped steel bar 601 to make punch holes 6011 in the U-shaped steel bar 601 upon down stroke of the punch die 311 with the upper mold 34 (see FIG. 26). Therefore, by means of controlling the air cylinders 321, 322, 323, 324, 325 to adjust the position of each of the punch dies 311, 312, 313, 314, 315, the desired punch pattern is achieved.

As indicated above, the invention has the following features and advantages:

1. The steel sheet material 6 is flattened, punched, and cut off subject to the desired length, and then the punched steel sheet material is rammed into the desired U-shaped steel bar 601 or Z-shaped steel bar 602, which is then straightened into the desired finished product. Therefore, the finished product has a good shape and quality without deformation.

2. The punch dies 311, 312, 313, 314, 315 of the punch press 31 can be selectively operated to punch steel sheet material 6 with punch holes subject to the desired punch pattern, i.e., the U/Z-shaped steel bar manufacturing system can make C/Z-shaped steel bars having punch holes of different punch patterns through a continuous manufacturing process without interruption.

3. Because one single punch press 31 can be operated to punch the steel sheet material with punch holes of any of a plural punch patterns, the invention saves much equipment cost and installation space.

What is claimed is:

1. An U/Z-shaped steel bar manufacturing process, which comprises the steps of:

a) feeding a steel sheet metal from a roll of steel sheet metal located on a spindle of a material rack to a flattening machine;

b) flattening the steel sheet metal to form a flattened steel sheet metal utilizing a flattening machine and feeding the flattened steel sheet metal into a punch press;

c) punching punch holes in the flattened steel sheet metal and cutting the flattened steel sheet metal to a predetermined length forming a punched steel sheet metal having a plurality of holes having a predetermined pattern utilizing a plurality of punch dies of the punch press;

d) rolling the punched steel sheet metal into a steel bar having a cross section having a predetermined shape utilizing ramming rolls of a roll forming unit, the predetermined shape is selected from a group consisting of a U shape and a Z shape; and e) straightening the steel bar utilizing a straightening machine to form the U/Z-shaped steel bar, wherein in the punching step c), the predetermined pattern is formed by selectively moving a selected punch die of a plurality of a plurality of punch dies between punching and non-punching positions, when the selected punch die is located in the punching position, a plurality of heads of the selected punch die are located on a bottom surface of the selected punch die positioning a plurality of punch rods connected thereto in a punching rod position, and, when the selected punch die is located in the non-punching position, the plurality of heads of the selected punch die are located entirely in recessed portions located in the bottom surface of the selected punch die positioning the plurality of punch rods connected thereto in a non-punching rod position.

2. The process according to claim 1, wherein, in the punching step c), each of the plurality of heads is directly connected to one of a plurality of punch rods.

3. The process according to claim 1, wherein, in the punching step c), each selected punch die of the plurality of punch dies has a cylinder selectively moving the selected punch die between the punching and non-punching positions.

4. The process according to claim 1, wherein, in the punching step c), when the selected punch die is located in the punching position, an entire top surface of each of the plurality of heads of the selected punch die is located adjacent to a flat portion of the bottom surface of the selected punch die.

* * * * *